United States Patent [19]

Dren et al.

[11] Patent Number: 4,803,942

[45] Date of Patent: Feb. 14, 1989

[54] BOAT, KEEL AND HULL PROTECTOR

[76] Inventors: Joseph Dren, P.O. Box 1021, Gilbert, Minn. 55741; Allen Dren, 418 First St. North West, Chisholm, Minn. 55719

[21] Appl. No.: 936,890

[22] Filed: Dec. 2, 1986

[51] Int. Cl.[4] ..... B63B 59/02

[52] U.S. Cl. ..... 114/219; 188/32; 405/1

[58] Field of Search ..... 405/1, 7; 114/219, 344; 188/6, 32

[56] References Cited

U.S. PATENT DOCUMENTS

| | | | |
|---|---|---|---|
| 2,896,564 | 7/1959 | Wright | 405/1 |
| 2,940,414 | 6/1960 | Moore | 114/219 |
| 3,000,021 | 9/1961 | Lang | 114/219 |
| 3,055,022 | 9/1962 | Vallquist | 114/219 |
| 3,339,217 | 9/1967 | Gudmunson | 114/344 |
| 3,498,252 | 3/1970 | Peacock | 114/219 |
| 3,693,574 | 9/1972 | Dickey | 114/219 |
| 3,742,534 | 7/1973 | Guest | 114/344 |
| 3,993,167 | 11/1976 | Reed | 188/32 |
| 4,399,893 | 8/1983 | Switzer | 188/32 |

FOREIGN PATENT DOCUMENTS

| | | | |
|---|---|---|---|
| 2075923 | 11/1981 | United Kingdom | 405/1 |

*Primary Examiner*—Sherman D. Basinger
*Assistant Examiner*—Thomas J. Brahan
*Attorney, Agent, or Firm*—Peterson, Wicks, Nemer & Kamrath

[57] ABSTRACT

A landing apparatus is disclosed for use during the landing or beaching of a boat, a vessel, or the like to protect the keel and hull bottom from injury and abrasion. The apparatus (12) employs an elongated semi-rigid member (20) disposed longitudinal to the bottom surface of the boat. Rigid and resilient upper support blocks (4) are provided on member 2 or and are angled in such a way (2) and spaced in such a way (6) to accept and cradle the keel of a boat and have surface contact with the hull so as to offer complete protection during the beaching of the latter. Said apparatus (12) also employs strips of material (8) spaced (16) on the underside of the apparatus so as to provide a non-slip surface on the bottom side of apparatus (12) for engagement with the contact surface of the beach.

17 Claims, 2 Drawing Sheets

BOAT, KEEL AND HULL PROTECTOR

BACKGROUND

1. Field of Invention

This invention relates to the field of a portable boat-landing apparatus for protecting the keel and hull from being damaged during the beaching operation of the boat.

2. Description of Prior Art

The continued desire of motorboat owners and operators to beach their boats at areas other than at established permanent landing facilities or docks, means that a more effective device has to be utilized. Boat owners well know the damage that can occur in trying to beach a boat on a rocky or abrasive shore line. Damage can be significantly greater if the boat is manufactured from wood or fiberglass. A number of attempts have been made in the prior art to eliminate this perplexing problem, but such attempts have had little success because of either their nature of construction, or the awkwardness of trying to employ them in an actual beaching operation. Another problem in the prior art was the possible deterioration of components due to immersion in water.

Therefore, most boat owners would find it highly desirable to have an apparatus which would greatly alleviate the problem of damage to both the keel and hull during an actual beaching operation.

OBJECTS AND ADVANTAGES

Accordingly, objects and advantages of this invention are to provide a portable boat-landing apparatus, designed with simplicity in mind, which can be easily laid out in front of the boat in the intended landing and beaching operation and also which can be easily removed with the intention of shoving out to sea.

Another important object and advantage of this invention is to provide a boat-landing apparatus which acts as a shock absorber in the beached mode against the rocking of the boat due to the action of waves.

Still another object and advantage of this invention is to provide a boat-landing apparatus providing complete protection and substantially eliminating any damage to both the keel and hull boat bottom during the beaching operation.

Yet another object and advantage of this invention is to provide a boat-landing apparatus which may be manufactured economically from commercially available neoprene rubber, which is resistant to water operations and wear and also which is very resilient for its use in acting like a shock absorber.

Readers will find further objects and advantages of the invention from a consideration of the ensuing description and the accompanying drawings.

DRAWING FIGURES

DESCRIPTION OF APPARATUS

Figure 1:
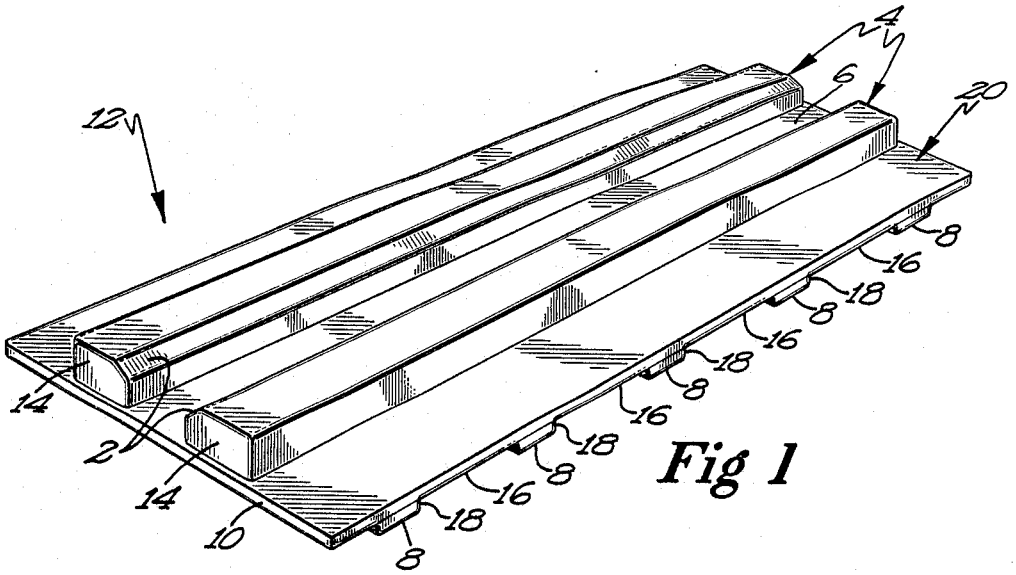
FIG. 1 is a perspective view of a boat-landing apparatus according to the present invention in its upright position.
Figure 2:
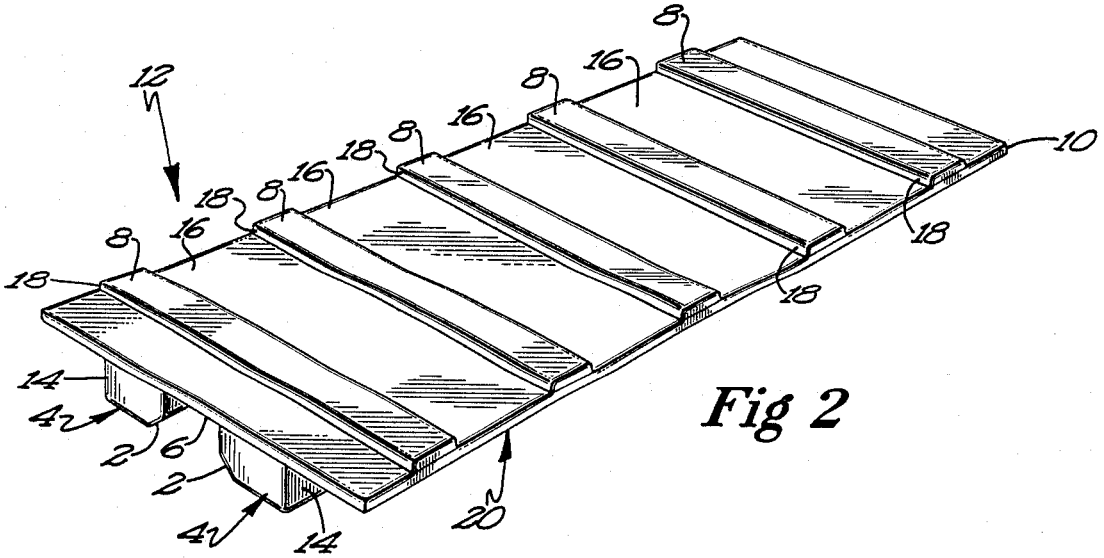
FIG. 2 is a perspective view of the underside of the boat-landing apparatus of FIG. 1.
Figure 3:
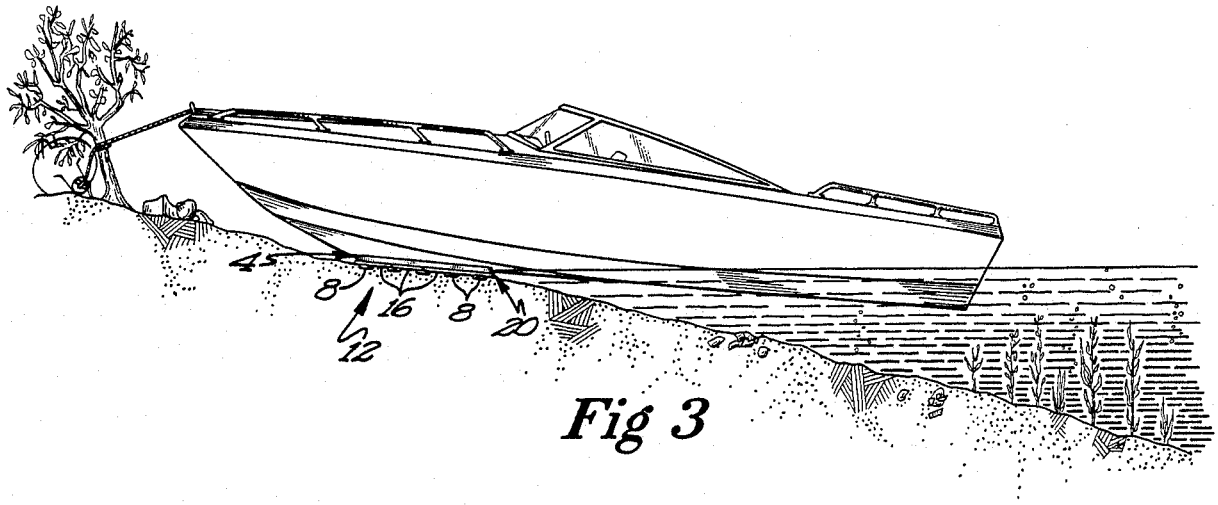
FIG. 3 is a side view of the boat-landing apparatus of FIG. 1 in place under the bottom of the boat in a beaching operation.
Figure 4:
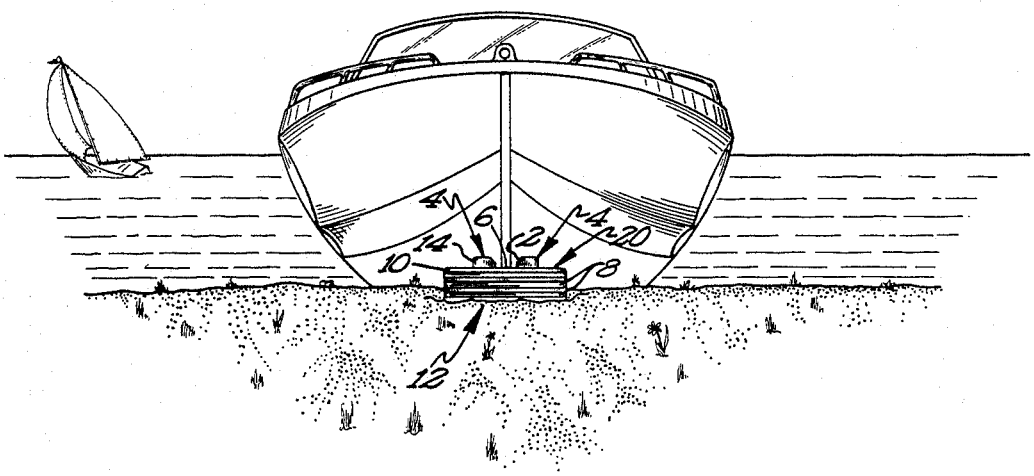
FIG. 4 is a front view of the boat-landing apparatus of FIG. 1 in place under the bottom of the boat in a beaching operation.

FIGS. 1 and 2 shows a boat landing apparatus according to the present invention and designated by the numeral 12. Boat-landing apparatus 12 is comprised of a mat 20 of neoprene rubber of sufficient width and length, 16 inches by 38 inches, and to be of sufficient thickness 10, one half inch is desirable, to be used as a sturdy base for solid neoprene rubber support blocks 4. Two blocks 4, which are 3 inches wide by 38 inches long and 1 inch in height 14, are bonded to the base mat 20 with an elastomeric bonding agent and are spaced 2 inches apart from each other forming a spacing 6 to universally fit most types of boat keels.

An angle 2 of 30 to 35 degrees is cut in the upper surface of solid neoprene support blocks 4 adjacent spacing 6 so that the support blocks 4, cradle the keel of a boat. On the underside of the base mat 20, strips of neoprene rubber 8, idealy having a height 18 of ½ inch and a dimension of 2 inches in width by 16 inches in length, are bonded to the bottom of base mat 20 with an elastomeric bonding agent and are spaced by even spacings 16. The strips 8 serve as a non-slip surface for different types of shore lines.

As an alternative, instead of bonding all the components together, a mold can be made in which the neoprene rubber is poured with all the dimensions as noted above to produce an economical boat-landing device.

In Use Operation

Prior to beaching of the boat, the apparatus 12 is cast over the bow along with a crew member to position apparatus 12, with the keel of the boat and to guide the keel along spacing 6 while at the same time gently lifting and pulling the boat on the apparatus 12 thereby making a safe beaching of the boat and protecting the keel and hull. To make a launch, one would gently lift up on the boat and push the boat off of apparatus 12, guiding the keel along spacing 6 to facilitate a good launch. After launching the apparatus 12 may be picked up and stored in the boat.

Those skilled in the art can see that this invention can achieve its intended purpose, is economical to manufacture, is easy to install and remove, and requires no maintenance.

We claim:

1. Apparatus for protecting the keel and hull of a boat or the like during landing of the boat on a beach comprising, in combination: a mat having an upper surface, a bottom surface, and a longitudinal axis; means located on the upper surface of the mat for guiding the keel of the boat along the longitudinal axis of the mat and for supporting the hull of the boat for protecting the boat during landing of the boat on the beach; and means located on the bottom surface of the mat for providing a non slip surface for engagement with the beach comprising strips located on the bottom surface of the mat in a space relation, with the strips having rectangular cross sections in vertical planes parallel to the longitudinal axis of the mat, with the strips having a longitudinal axis perpendicular to the longitudinal axis of the mat, with the mat and the strips being flexible to engage the beach.

2. The apparatus of claim 1 wherein the keel extends a height from the hull of the boat, and wherein the guiding and supporting means comprises a channel defined by first and second spaced surfaces, with the surfaces of the channel including a first surface portion extending generally perpendicularly to the upper surface of the mat and a second angled portion extending outwardly from the first surface portion at an obtuse angle, with the first surface portions of the first and second surfaces being parallel and spaced to receive keels of various types and sizes, with the channel having a depth generally greater than the height of the keel of the boat and with the second surface portions of the first and second surfaces supporting the hull of the boat and cradling the keel of the boat between the first surface portions of the first and second surfaces of the channel.

3. The apparatus of claim 2 further comprising, in combination: first and second support blocks located on the upper surface of the mat, with the first support block including the first surface of the channel and with the second support block including the second surface of the channel.

4. The apparatus of claim 3 wherein the mat, the strips, and the support blocks are formed of resilient and generally solid, substantially noncompressible material for acting as a shock absorber to the boat and for supporting the boat on the beach.

5. The apparatus of claim 4 wherein the mat, the strips, and the support blocks are formed of solid, neoprene rubber.

6. The apparatus of claim 3 wherein the support blocks are bonded to the upper surface of the mat and wherein the strips are bonded to the bottom surface of the mat.

7. The apparatus of claim 1 wherein the strips are bonded to the bottom surface of the mat.

8. The apparatus of claim 1 wherein the mat, the guiding and supporting means, and the strips are formed of resilient and generally solid, substantially noncompressible material for acting as a shock absorber to the boat and for supporting the boat on the beach.

9. The apparatus of claim 8 wherein the mat, the guiding and supporting means, and the strips are formed of solid, neoprene rubber.

10. Apparatus for protecting the keel and hull of a boat or the like during landing of the boat on a beach comprising, in combination: a mat having an upper surface and a bottom surface; and means located on the upper surface of the mat for guiding the keel of the boat and for supporting the hull of the boat for protecting the boat during landing of the boat on the beach, with the mat and the guiding and supporting means being formed of resilient and generally solid, substantially noncompressible material for acting as a shock absorber to the boat and for supporting the boat on the beach, and with the mat and the guiding and supporting means being flexible and with the bottom surface of the mat adapted for engagement with the beach.

11. The apparatus of claim 10 wherein the mat and the guiding and supporting means are formed of solid neoprene rubber.

12. The apparatus of claim 11 wherein the keel extends a height from the hull of the boat, and wherein the guiding and supporting means comprises a channel defined by first and second spaced surfaces, with the surfaces of the channel including a first surface portion extending generally perpendicularly to the upper surface of the mat and a second angled portion extending outwardly from the first surface portion at an obtuse angle, with the first surface portions of the first and second surfaces being parallel and spaced to receive keels of various types and sizes, with the channel having a depth generally greater than the height of the keel of the boat and with the second surface portions of the first and second surfaces supporting the hull of the boat and cradling the keel of the boat between the first surface portions of the first and second surfaces of the channel.

13. The apparatus of claim 12 further comprising, in combination: first and second support blocks located on the upper surface of the mat, with the first support block including the first surface of the channel and with the second support block including the second surface of the channel.

14. The apparatus of claim 13 wherein the support blocks are bonded to the upper surface of the mat and wherein the strips are bonded to the bottom surface of the mat.

15. Apparatus for protecting the keel and hull of a boat or the like during landing of the boat on a beach, with the keel extending a height from the hull of the boat, comprising, in combination: a mat having an upper surface and a bottom surface; and means located on the upper surface of the mat for guiding the keel of the boat along the longitudinal axis of the mat and for supporting the hull of the boat for protecting the boat during landing of the boat on the beach, with the guiding and supporting means comprising a channel defined by first and second spaced surfaces, with the surfaces of the channel including a first surface portion extending generally perpendicularly to the upper surface of the mat and a second angled portion extending outwardly from the first surface portion at an obtuse angle, with the first surface portions of the first and second surfaces being parallel and spaced to receive keels of various types and sizes, with the channel having a depth generally greater than the height of the keel of the boat and with the second surface portions of the first and second surfaces supporting the hull of the boat and cradling the keel of the boat between the first surface portions of the first and second surfaces of the channel.

16. The apparatus of claim 15 further comprising, in combination: first and second support blocks located on the upper surface of the mat, with the first support block including the first surface of the channel and with the second support block including the second surface of the channel.

17. The apparatus of claim 16 wherein the support blocks are bonded to the upper surface of the mat.

* * * * *